United States Patent [19]

Teichmann

[11] Patent Number: 4,527,307

[45] Date of Patent: Jul. 9, 1985

[54] WASTE COLLECTOR FOR A CARD

[75] Inventor: Paul Teichmann, Monchen-Gladbach, Fed. Rep. of Germany

[73] Assignee: Trützschler GmbH & Co. KG, Monchen-Gladbach, Fed. Rep. of Germany

[21] Appl. No.: 580,717

[22] Filed: Feb. 16, 1984

[30] Foreign Application Priority Data

Feb. 26, 1983 [DE] Fed. Rep. of Germany ..... 3306891
Dec. 5, 1983 [DE] Fed. Rep. of Germany ..... 3343936

[51] Int. Cl.[3] ..... D01G 15/82
[52] U.S. Cl. ..... 19/105; 19/107
[58] Field of Search ..... 19/105, 107

[56] References Cited

U.S. PATENT DOCUMENTS 3,144,685 8/1964 Aoki ..... 19/107 X
3,144,686 8/1964 Aoki ..... 19/107 X
3,169,278 2/1965 Aoki ..... 19/105
3,512,217 5/1970 Bettoni ..... 19/107 X
3,537,144 11/1970 King ..... 19/107
3,955,244 5/1976 Jenkins ..... 19/107
4,346,500 8/1982 Demuth ..... 19/107 X

FOREIGN PATENT DOCUMENTS 1290852 3/1969 Fed. Rep. of Germany .
1510434 1/1970 Fed. Rep. of Germany .
1510227 10/1971 Fed. Rep. of Germany .
2024590 4/1972 Fed. Rep. of Germany .

*Primary Examiner*—Louis K. Rimrodt
*Attorney, Agent, or Firm*—Spencer & Frank

[57] ABSTRACT

An apparatus for removing waste from a card has a circulating perforated component supported spaced from the licker-in in the lower zone thereof; a vacuum generator connected with the inside of the perforated component for drawing air through the perforated component; and a connecting chamber extending from an opening in the lower zone of the licker-in to the perforated component for providing a passage of air and waste drawn by the vacuum.

11 Claims, 7 Drawing Figures

WASTE COLLECTOR FOR A CARD

BACKGROUND OF THE INVENTION

This invention relates to an apparatus for collecting waste such as dust, shell fragments, short fibers and the like in a card such a carding machine or a roller card unit.

In known cards, the waste is separated in a downward direction by means of mote knives, screens or the like and is drawn away by vacuum from the space underneath the licker-in. It is a disadvantage of known waste collecting arrangements that the separated waste underneath the feeding table may be partially drawn-in in the direction of rotation of the licker-in and thus, such waste re-enters into the gap defined between the licker-in clothing and the lower cover plate. As an undesired result, waste particles are reintroduced in the fiber material to be processed by the card.

SUMMARY OF THE INVENTION

It is an object of the invention to provide an improved waste collecting apparatus of the above-outlined type from which the discussed disadvantage is eliminated and which effectively collects the waste separated particularly in the zone of the licker-in and prevents such waste from being reintroduced into the carding process.

This object and others to become apparent as the specification progresses, are accomplished by the invention, according to which, briefly stated, the lower zone of the licker-in communicates by means of a connecting space, with a circulating perforated component (such as a screen drum or endless screen belt) which surrounds a suction chamber.

By providing that the openings through which the waste leaves the zone of the licker-in are in immediate communication with a screen drum through which a radially inwardly directed air flow is maintained, the waste is positively drawn in the direction of the screen drum. The closed connecting space between the openings underneath the licker-in and the screen drum prevents the waste from being introduced into irregular, uncontrolled air streams, and is particularly prevented from being reintroduced into the intake zone of the licker-in.

According to a further feature of the invention, that zone within the screen drum which is oriented away from the connecting space is blocked by an air shield, whereby a sink is formed to permit the waste to drop downwardly from that portion of the screen drum surface through which no air flows. Preferably, the suction effect of the sink is adjustable to thus reliably ensure that the separated waste is collected on the circumference of the screen drum and is retained there so that the carding process is not interfered with. The waste collected on the surface of the screen drum is directed into a waste collecting device for example, a waste collecting conduit connected to a vacuum source.

DESCRIPTION OF THE PREFERRED EMBODIMENTS

Figure 1:
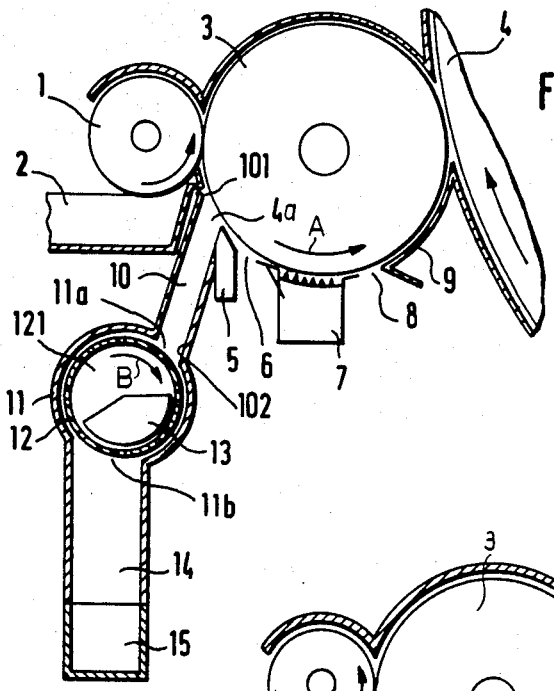
FIG. 1 is a schematic sectional side elevational view of a preferred embodiment of the invention.

Turning to FIG. 1, there is shown the inlet zone of a known carding machine, including a feed roller 1, a feed table 2 arranged underneath the feed roller 1, a licker-in 3 and a carding cylinder 4. Underneath the licker-in 3, immediately facing the clothing (not shown) thereof, there are situated in series, as viewed in the direction of rotation of the licker-in 3 (indicated by the arrow A), an opening 4*a*, a mote knife 5, an opening 6, a stationary carding element 7, an opening 8 and a cover plate 9. The opening 4*a* is coupled to one end 101 of a connecting conduit (closed connecting space) 10, whose other end 102 merges into an opening 11*a* provided in a housing 11. The housing 11 surrounds a rotating (circulating) perforated component 12 which may be, for example, a rotary screen drum of conventional construction. The screen drum 12 is situated in the vicinity of the licker-in 3, that is, the connecting conduit 10 is so short that an effective removal of the waste by vacuum (suction) effect may be performed without the vacuum stream excessively interfering with the fiber feed to the licker-in 3. The screen drum 12 surrounds a vacuum chamber 121 in which, remote from the end 102 of the connecting conduit 10, there is arranged an air shield 13 which divides the vacuum chamber 121 into a vacuumized and a non-vacuumized zone. In this manner, the vacuum chamber 121 of the screen drum 12 is situated immediately adjoining the end 102 of the connecting conduit 10. The waste (not shown) accumulates on the outer face of the screen of the screen drum and is transported, in the direction of rotation of the screen drum, as indicated by the arrow B, to the non-vacuumized zone of the screen drum 12 where the waste drops through a further opening 11*b* in the housing 11 into a transport conduit 14 and then into a waste removing duct 15 which preferably is coupled to a vacuum source. The vacuum-generating device for the suction chamber 121 of the screen drum 12 is of known construction and is therefore not shown. The force of the vacuum may be varied, for example, by altering the speed of the vacuum-generating fan.

Figure 2:
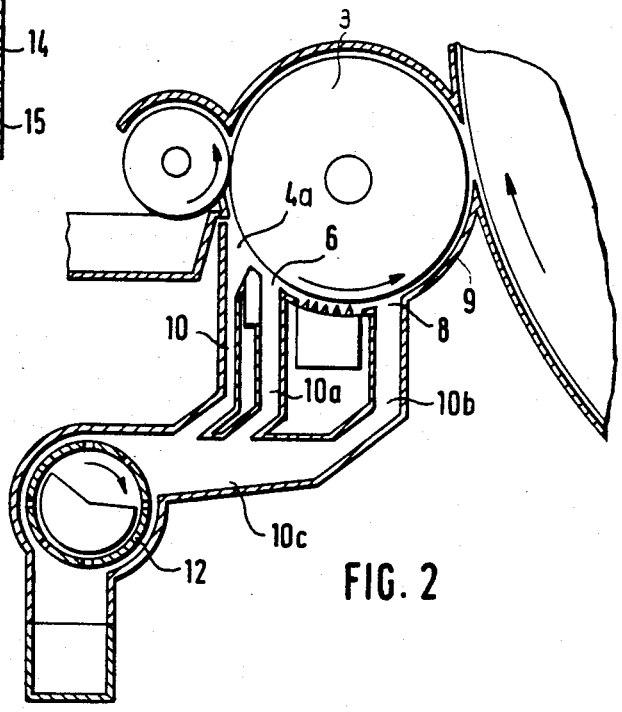
FIG. 2 is a schematic sectional side elevational view of another preferred embodiment of the invention.

Turning now to FIG. 2, there is shown an apparatus similar to that of FIG. 1 in which, however, in addition to the connecting conduit 10 there are provided two further connecting conduits 10*a* and 10*b* which have an opening 6 and 8, respectively, immediately at the licker-in 3. The conduits 10, 10*a* and 10*b* open into a common channel 10*c* which leads to the screen drum 12.

Figure 3:
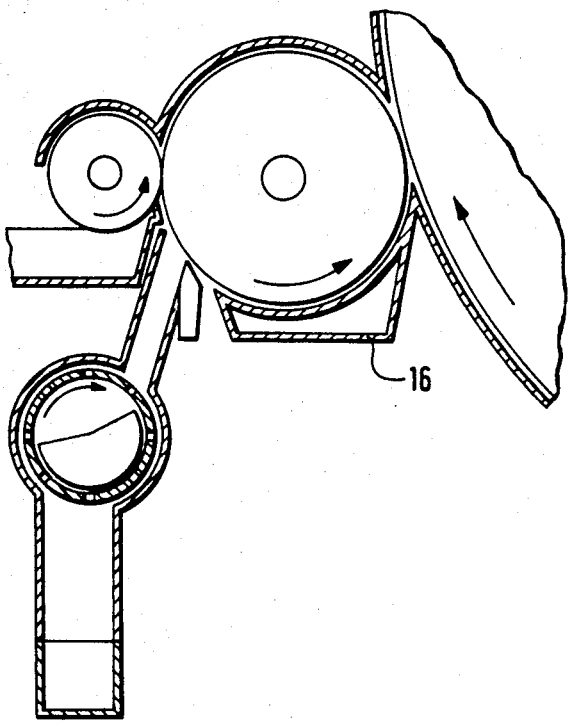
FIG. 3 is a schematic sectional side elevational view of still another preferred embodiment of the invention.

FIG. 3 shows a further embodiment of the invention which is similar to FIG. 1 but in which the stationary carding element 7 of FIG. 1, the opening 8 and the cover plate 9 of the FIG. 1 embodiment are replaced by a closed cover 16.

Figure 4:
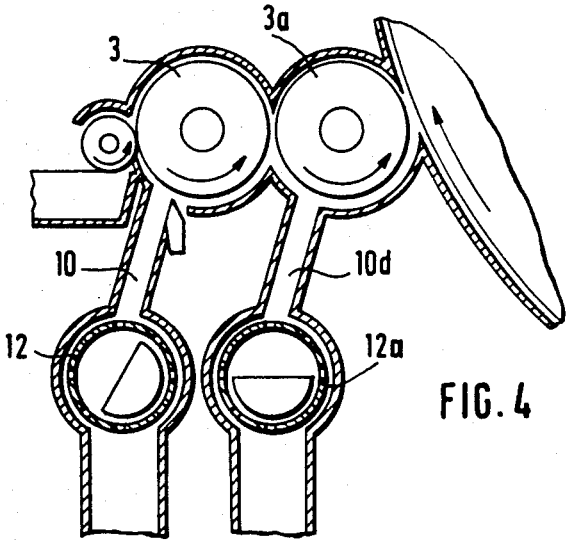
FIG. 4 is a schematic sectional side elevational view of a further preferred embodiment of the invention.

In the embodiment illustrated in FIG. 4 there are provided two licker-ins 3 and 3*a* in series and with each licker-in there is associated a separate screen drum 12 and 12*a*, respectively, coupled to the licker-in by respective connecting conduits 10 and 10*d*.

Figure 5A:
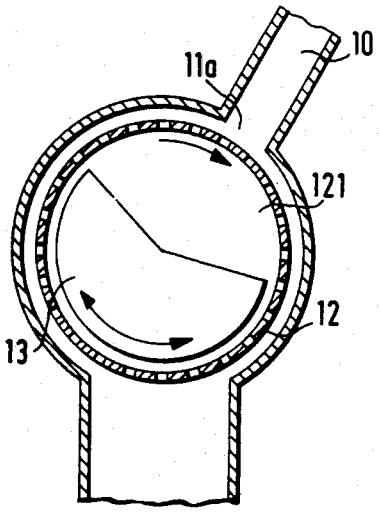
FIGS. 5*a* and 5*b* are enlarged schematic sectional side elevational details of a portion of the structure of FIG. 1 shown in different operational positions.
Figure 5B:
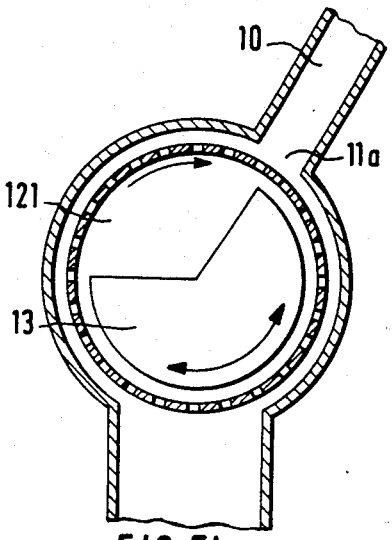

Turning now to FIGS. 5*a* and 5*b* there is shown an angularly adjustable (rotatable) air shield 13 by means of which the opening 11*a* of the connecting conduit 10 may be partially or entirely closed to thus regulate in a simple manner the suction effect of the air stream passing through the screen drum 12. According to FIG. 5*a* the air shield 13 is in a position in which the opening 11*a* is entirely uncovered so that the suction chamber 121 within the screen drum 12 is fully effective. According to FIG. 5*b*, the air shield 13 partially covers the opening 11*a* thus reducing the suction effect on the waste through the conduit 10.

Figure 6:
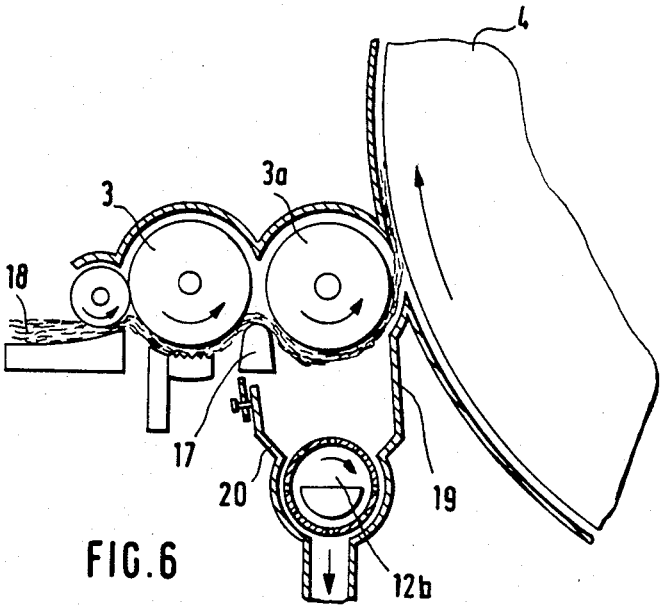
FIG. 6 is a schematic sectional side elevational view of still another preferred embodiment of the invention.

Turning now to the embodiment illustrated in FIG. 6, there are shown two serially arranged licker-ins 3 and 3*a*. The fiber lap 18 contacts the licker-ins 3 and 3*a* along their lower arcuate zone and is guided between the licker-ins 3 and 3*a* over a guide member 17 which is situated between the licker-ins 3 and 3*a* in the zone where they are closest to a tangential relationship. The guide member 17 has a length which extends over the entire axial dimension (width) of the licker-ins 3 and 3*a*. Expediently, the guide member 17 is situated possibly close to the circumference of the licker-ins 3 and 3*a* and is in alignment with a line which passes through the mid point of the clearance between the two licker-ins 3 and 3*a* and which is perpendicular to the plane containing the two licker-in axes. The fiber lap 18 advanced by the first licker-in 3 is guided over the guiding component 17 where it undergoes a sharp change in direction before it is divided (pulled apart) into individual fibers or fiber groups by the rapidly rotating second licker-in 3*a*. The guide component 17 serves as a backup support for the fiber-resolving operation and preferably has a rounded surface to avoid damage to the fibers. The rounded surface is preferably smooth, but may be provided with grooves or knurling or other patterns over one part or over its entire length. The guide member 17 may form part of a cover which extends over a part of the lower arc of the first licker-in 3. The circumferential speed of the second licker-in 3*a* is preferably at least twice the circumferential speed of the first licker-in 3 so that the fiber lap 18 is resolved essentially into individual fibers or fiber groups and, at the same time, by virtue of the guide member 17, the fiber lap 18 undergoes a sharp change in direction before it enters the effective zone of the second licker-in 3*a*. In this manner, the fiber lap 18 is very thoroughly pulled apart (resolved) so that waste material and dust still remaining in the fiber lap 18 can be removed to a high percentage. The shape and size of the guide member 17 may be adapted to the specific functional and constructional requirements. Its surface may be planar and smooth, while its portion contacting the fiber lap is preferably rounded. The rounded surface too, may be provided with grooves, knurls or the like. As noted earlier, in operation, the appropriately positioned guide member 17 functions as a backup support for resolving the fiber lap 18 by the licker-in 3*a*; the guide member 17 is adjusted to assume its most advantageous position for the staple length of the fibers to be processed. Deflecting plates 19 and 20 form an outlet through which the waste and very short fibers may drop out after the fiber lap 18 is pulled apart by the licker-ins. The distance between the guide member 17 and the deflecting plate 19 is adjustable such that the size of an air inlet opening between the two components may be adjusted. The air passing between the guide member 17 and the deflecting plate 19 by virtue of the rotation of the licker-ins draws off for recovery all long fibers advanced from the licker-in 3 onto the licker-in 3*a*. The air stream, however, should not be of such a strength that it prevents the waste from exiting between the deflecting plate 19 and 20. If the circumferential speed of the licker-in 3*a* is greater than that of the licker-in 3, the individual fibers of the fiber lap 18 are necessarily drawn off the surface of the licker-in 3 so that the fiber lap 18 is resolved and loosened. As a result, as well as by virtue of the sharp change in direction imparted by the guide component 17, the fiber lap 18 is resolved into individual fibers whereby waste material is freed and can drop through the outlet formed between the deflecting plates 19 and 20. The waste, such as trash, short fibers and dust is received by the screen drum 12*b* and is drawn away. The intensity of the cleaning in the zone of the licker-ins 3 and 3*a* depends from the rotational speed of the licker-ins, from the setting of the guide component 17 and from the clothing of the licker-ins 3 and 3*a*. The adjustment of the cooperating components is made for the purpose of a maximum cleaning accompanied by an acceptable loss of material. It has been found that best results may be obtained if the circumferential speed of the licker-in 3*a* is between twice and six times, preferably between 2.5 and four times that of the licker-in 3.

The fiber lap 18 which is situated on the clothing of the licker-in 3, runs between the licker-in 3 and the guide component 17 upwardly and is thereafter lifted off the licker-in 3 by the licker-in 3*a* and then the fiber lap 18 drops downwardly on the other side of the guide component 17 and is grasped by the clothing of the licker-in 3*a* which thus functions as a stretching (drawing) roller. The arrangement includes two stretching (drawing) zones: one between the guide component 17 and the licker-in 3 and a second between the guide component 17 and the clothing of the licker-in 3*a* which fully determines the motion of the fiber lap 18. It was found that a yarn spun from a stretched sliver made by a card according to the invention had a greater strength compared to yarns spun from conventionally prepared slivers. There were indications that in the improved product the fibers were aligned to a greater extent in a parallel relationship and/or the hooks at the frontal or rear end of the fibers within the fiber lap were straightened out so that there was obtained an appreciable improvement of the yarn quality. It is assumed that the drawing effect (change of direction, stretching) and the described arrangement of the guide component 17 provide that the fibers in the fiber lap 18 are lifted off by the clothing of the licker-in 3 at an obtuse angle which may be approximately equal to 90° so that the hook-shaped ends of the fibers which are held firmly by the clothing of the licker-in 3*a* are straightened out. Hook-shaped frontal fiber ends are straightened out by the downward stripping effect of the clothing of the licker-in 3 and the drawing effect. Such a straightening of the fibers in the fiber lap 18 leads, to a certain extent, to an increase of the mean length of the fibers so that a higher yarn strength is achieved. In case a lesser number of hook-shaped fibers is present, it is feasible to spin the drawn sliver produced by the carding machine or the roller card unit directly into a yarn without the necessity of first passing the material through one or more drafting units.

It will be understood that the above description of the present invention is susceptible to various modifications, changes and adaptations, and the same are intended to be comprehended within the meaning and range of equivalents of the appended claims.

What is claimed is:

1. In an apparatus for removing waste from a card having a feed table on which fiber material is advanced, a licker-in receiving fiber material from the feed table and a carding cylinder receiving fiber material from the licker-in; said apparatus including means defining an opening in a lower zone of said licker-in; vacuum means for drawing away waste from said card; the improvement comprising (a) a rotary perforated component supported spaced from said licker-in in the lower zone thereof;

(b) means forming part of said vacuum means and situated within said perforated component for drawing air through said perforated component; and (c) means defining a connecting chamber extending from said opening to said perforated component for providing a passage of air and waste drawn by said vacuum means.

2. An apparatus as defined in claim 1, wherein said opening is situated downstream of said feed table as viewed in a direction of material feed on said feed table.

3. An apparatus as defined in claim 1, wherein said connecting chamber comprises a conduit.

4. An apparatus as defined in claim 1, wherein said perforated component comprises a screen drum.

5. An apparatus as defined in claim 1, wherein said perforated component has a first perforated zone oriented towards said connecting chamber and a second perforated zone oriented away from said connecting chamber; further comprising an air shield supported inside said perforated component, said air shield obturating said second perforated zone.

6. An apparatus as defined in claim 5, further comprising a waste removing device communicating with said second perforated zone.

7. An apparatus as defined in claim 1, further comprising means for regulating the flow of air in said connecting chamber.

8. An apparatus as defined in claim 1, wherein said licker-in is a first licker-in; further comprising a second licker-in situated downstream of said first licker-in and cooperating with said carding cylinder; said perforated component being connected by said connecting chamber with said second licker-in.

9. An apparatus as defined in claim 8, wherein said opening, said connecting chamber and said rotary perforated component are each two in number; each said licker-in being associated with a separate opening, a separate connecting chamber and a separate perforated component.

10. An apparatus as defined in claim 8, further comprising a fiber material guide component in a space defined between said first and second licker-ins; said guide component being situated above said perforated component.

11. An apparatus as defined in claim 1, wherein said connecting chamber comprises deflecting plates directing flow from said licker-in to said perforated component.

* * * * *